United States Patent [19]

Takagi

[11] 4,160,403

[45] Jul. 10, 1979

[54] VARIABLE DELIVERY HYDRAULIC EQUIPMENT

[76] Inventor: Kinzo Takagi, 4-15, 5-chome, Kurichara, Niiza-shi, Saitama-ken, Japan

[21] Appl. No.: 868,574

[22] Filed: Jan. 11, 1978

Related U.S. Application Data

[62] Division of Ser. No. 665,194, Mar. 9, 1976, Pat. No. 4,086,845.

[30] Foreign Application Priority Data

Mar. 14, 1975 [JP] Japan ..... 50-30917

[51] Int. Cl.[2] ..... F01B 3/10; F01B 13/04

[52] U.S. Cl. ..... 91/483; 91/488; 91/501

[58] Field of Search ..... 91/483, 488, 499, 501; 417/215, 488

[56] References Cited

U.S. PATENT DOCUMENTS

| | | | |
|---|---|---|---|
| 2,390,590 | 12/1945 | Holmes | 91/483 |
| 2,617,360 | 11/1952 | Barker | 91/501 |
| 2,923,251 | 2/1960 | DeLaney | 91/501 |
| 3,079,869 | 3/1963 | Purcell | 91/501 |
| 3,166,016 | 1/1965 | Thoma | 91/501 |
| 3,191,542 | 6/1965 | Hughes | 91/501 |
| 3,776,102 | 12/1973 | Katayama | 91/483 |
| 3,828,654 | 8/1974 | Wiethoff | 91/488 |
| 3,858,487 | 1/1975 | Abe et al. | 91/488 |

FOREIGN PATENT DOCUMENTS

| | | | |
|---|---|---|---|
| 798786 | 3/1936 | France | 91/501 |
| 1529432 | 5/1968 | France | 91/488 |

*Primary Examiner*—John J. Vrablik

*Attorney, Agent, or Firm*—Steele, Gould & Fried

[57] ABSTRACT

A variable delivery hydraulic equipment is designed to be operated as a pump or a motor and includes a cylinder block having a plurality of cylinder bores on the same circumference thereof and a plurality of plunger assemblies each disposed within the cylinder bore. The plunger assembly has a pair of plungers oppositely disposed within the cylinder bore so as to define a chamber therebetween and slidably movable within the cylinder bore. A pair of cams are disposed in contact with opposite plungers with the cylinder block disposed therebetween. The cams each have a cam surface for imparting a plurality of reciprocatory movements in one cycle to the opposite plunger in a manner that the moving velocities of the opposite plungers are different from each other in all phase position. The cam surfaces are formed to have sine curves each having two crests and a different stroke. In consequence, the volume of the chamber between the opposite plungers is always varied. The hydraulic equipment can perform a plurality of discharge and suction operations in one cycle without any pulsating movement. It is therefore possible to obtain a small-sized hydraulic equipment also capable of effecting a high speed operation.

7 Claims, 10 Drawing Figures

VARIABLE DELIVERY HYDRAULIC EQUIPMENT

This is a division, of application Ser. No. 665,194, filed Mar. 9, 1976 now U.S. Pat. No. 4,086,845.

This invention relates to a variable delivery hydraulic equipment and in particular to a variable delivery hydraulic equipment designed to be operated as a pump or a motor in which no thrust and radial loads are applied to a rotary shaft.

Conventionally known is a variable delivery hydraulic equipment in which each of plunger assemblies is inserted into each of an even number of axial cylinder bores provided on the periphery of a cylinder block which is rotated together with a rotary shaft. The plunger assembly comprises a pair of slidably movable opposite plungers between which a variable volume chamber is defined. The opposite plunger contacts with a cam having a cam surface including two crests and two troughs. When, for example, a hydraulic equipment acts as a pump, the rotary shaft is driven to cause a cylinder block to be rotated to permit the opposite plungers to be slidably moved in an axial direction through the corresponding cams. As a result, the volume of the chamber is varied thereby to cause an operational fluid such as a pressure oil to be discharged or sucked. In this case, the relative position of the cams is suitably set. The swinging or rotational movement of the cams causes the volume of the chamber to be varied in a stepless fashion. As a result, any discharge and suction amounts can be obtained. A bevel gear type means adapted to swing or rotate both the cams an equal amount in opposite directions through a gear mechanism is known as a means for effecting a relative displacement between the cams. Also known is a lever type means by which one of the cams is swung with the other cam fixed.

Since in the conventional variable delivery hydraulic equipment, however, the plungers are moved by using the same cam surface, the volume of the plunger chamber is not varied and no smooth operation is obtained due to a pulsating movement when the discharge or suction amount becomes zero. To avoid the pulsating movement, the cam surface having two crests and two troughs is utilized, but greater discharge and suction amounts are not obtained. Furthermore it is difficult to make the hydraulic equipment smaller in size. Since a means for swinging the cam is manually operated, an easy and reliable positioning of the cam can not be effected. It is therefore impossible to obtain a desired discharging amount or rotation torque and it is also impossible to automatically swing or rotate the cam during the operation.

It is accordingly the object of this invention to provide an improved variable delivery hydraulic equipment capable of obtaining any discharge amount or rotation torque free from any pulsating movement.

According to the preferred embodiment of this invention, there is provided a variable delivery equipment having a pair of cams having a plurality of crests and troughs whose cam surface imparts different moving velocities to the opposite plungers. The cam surfaces are formed to have a sine curve having a plurality of crests, for example, four crests and a different stroke. One cam can be automatically swung even during the operation relative to the other cam. It is preferred that the swingable cam can be swung by a piston-cylinder assembly which is operated by utilizing an operational fluid within the hydraulic equipment.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

Figure 1:
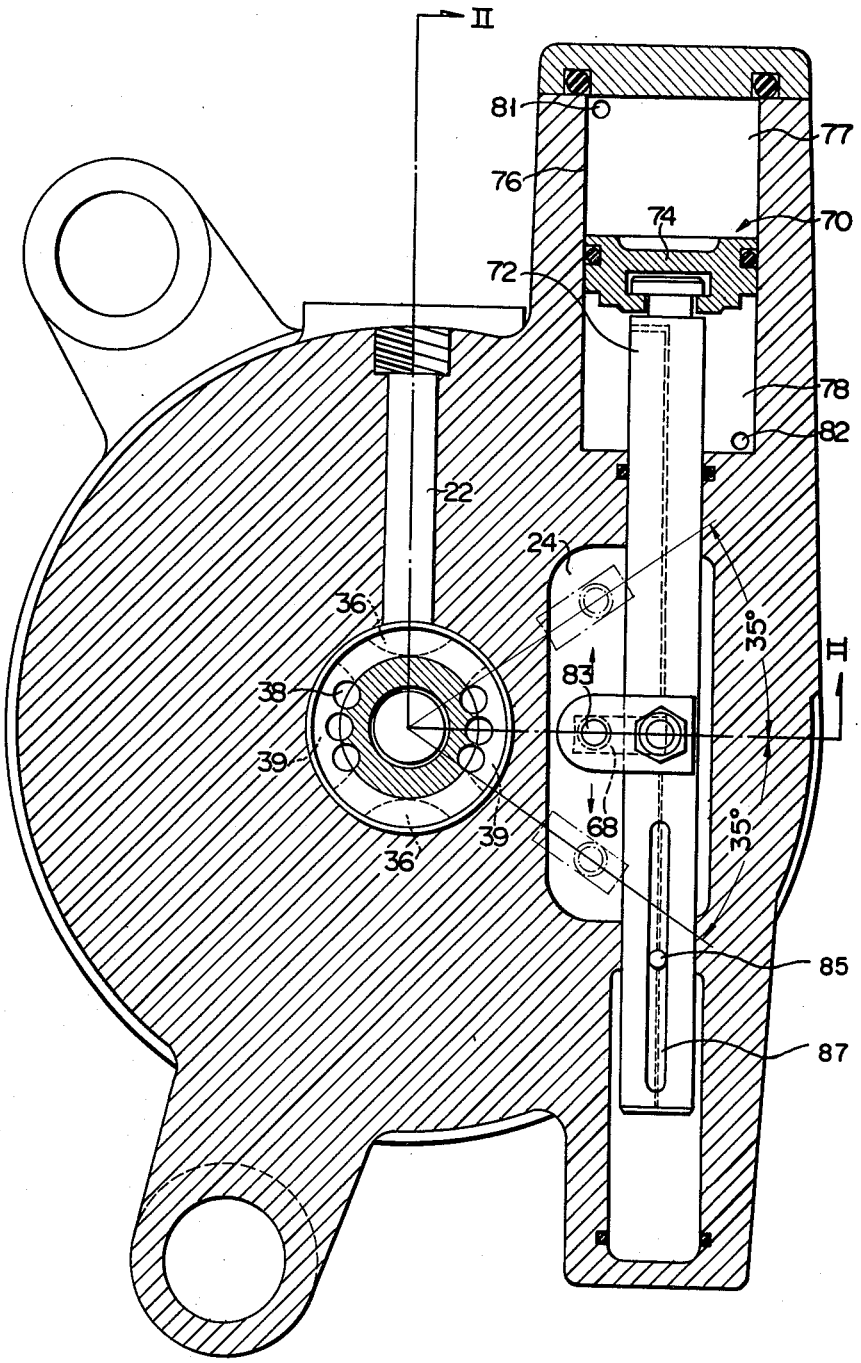
FIG. 1 is a side view showing a hydraulic equipment according to the preferred embodiment of this invention.
Figure 2:
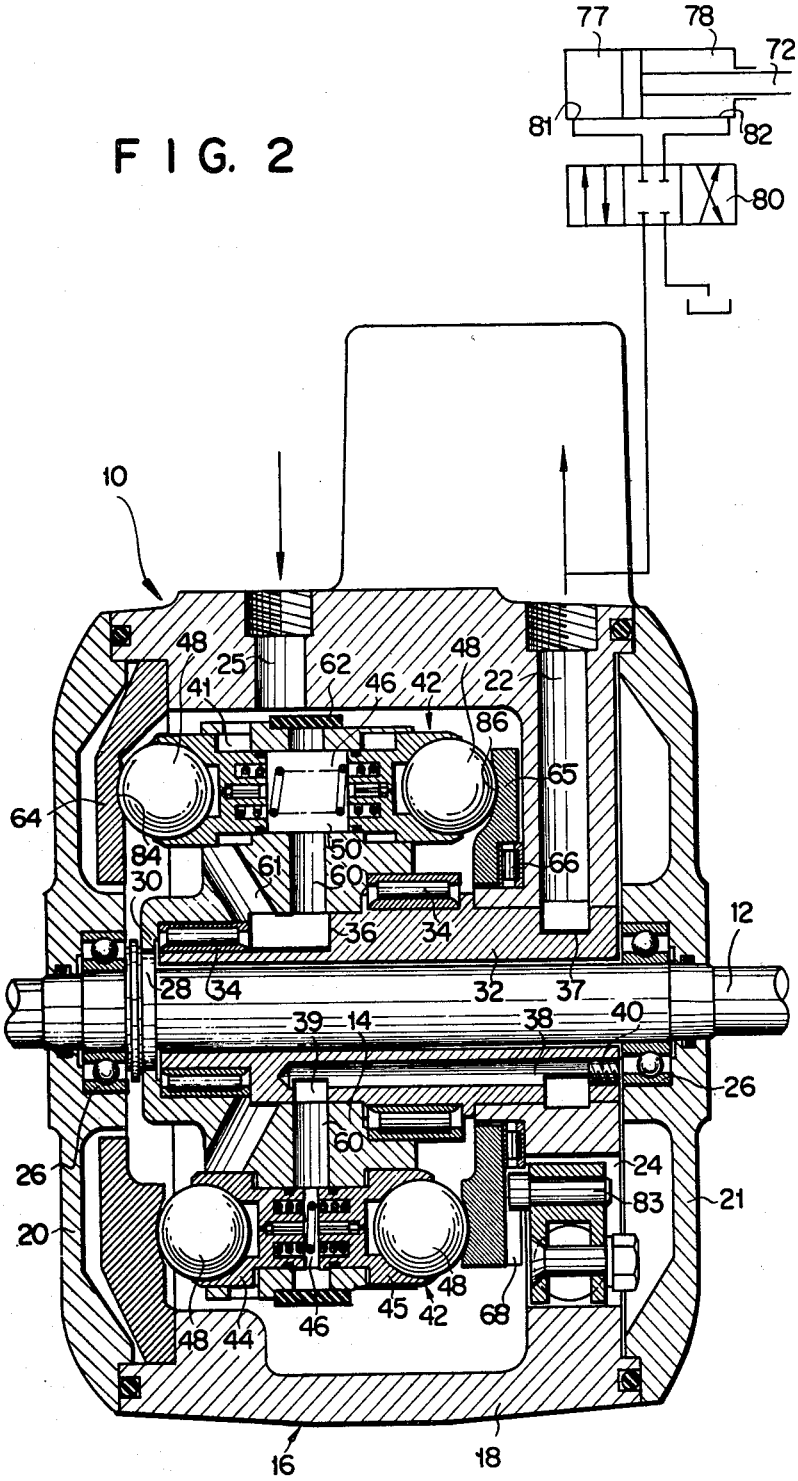
FIG. 2 is a longitudinal cross-sectional view as taken along line II—II in FIG. 1.

FIGS. 1 and 2 show a variable delivery hydraulic equipment 10. The equipment 10 includes a rotary shaft 12 which acts as a driving shaft when the equipment serves as a pump and as a driven shaft when the equipment serves as a motor, a cylinder block 14 rotated together with a rotary shaft 12 and having a plurality of plunger assemblies mounted thereon, and a housing 16 comprising a housing body 18 for housing a cylinder block 18 and end covers 20 and 21 secured to the housing body 18 so as to cover the open ends of the cylinder body.

A port 22 and a substantially rectangular window 24 are provided in a radial wall of the housing body 18 as shown in FIG. 2 and a port 25 is provided in a circular wall of the housing body 18. Each of the end covers 20 and 21 has a radial wall bearing 26 for rotatably supporting the shaft 12.

The rotary shaft 12 has a spline portion 28 near to the end cover 20 and the spline portion 28 is engaged with a spline portion 30 formed in the radial projecting wall of the cylinder block 14.

A stepped sleeve 32 is loosely fitted over the shaft 12 and holds the cylinder block 14 through radial roller bearings 34. The sleeve 32 has two radially symmetrical, arcuate grooves 36 in the stepped portion thereof, an annular groove 37 on the outer periphery thereof and communicating with the radial port 22 of the housing body 18, six axial bores 38 at the end cover 21 side thereof and communicating with the annular groove 37, and two radially symmetrical, arcuate grooves 39 located near to the stepped portion thereof and communicating with the bore 38. 40 is a sealing plug for closing the bore 38.

The cylinder 14 has, for example, eight axial cylinder bores 41 of stepped configuration equiangularly provided on the circumference thereof and a plunger assembly 42 is mounted in the respective cylinder bore 41.

Figure 3:
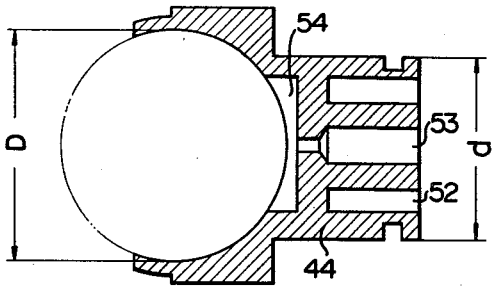
FIG. 3 is a partial, enlarged, longitudinal cross-sectional view showing the detail of one plunger of a plunger assembly in FIG. 2.
Figure 4:
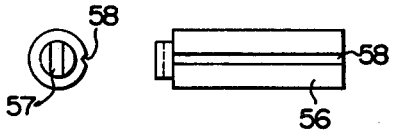
FIG. 4 is an enlarged view of a capillary plug incorporated in the plunger.

The plunger assembly 42 comprises a pair of opposite stepped plungers 44, 45 slidably inserted into the cylinder bore 41, a compression coil spring 46 disposed between the opposite plungers and adapted to urge the plunger outwardly and a pair of steel balls 48 revolvably anchored at the outer, large diameter end portion thereof. The spring 46 is not necessarily required, since the plungers 44 and 45 can be outwardly urged by a operational fluid. A chamber 50 is defined between the paired plungers 44, 45. As shown in FIG. 3 the plungers 44 and 45 have an annular groove 52 in which the spring 46 is received, an oil passage 53 and a oil space 54 communicating with the oil passage 53. The oil passage 53 needs to be made small-sized so as to always supply a small amount of operational oil by capillarity to the oil space 54. However, a small-diameter hole is difficult to manufacture and for this reason the oil passage 53 constitutes a stepped hole. The capillary plug 56 is inserted into the large diameter section of the stepped hole. As will be understood from FIG. 4, the capillary plug 56 is of a stepped type and has a large diameter section having an axial through groove 58 and a small diameter section across the diameter of which is formed a slot 57. The insertion of the capillary plug 56 into the oil passage 53 causes the operational oil to be passed through the groove 58 under the action of capillarity. The operational oil passed through the groove 58 is passed through the oil passage 53 toward the oil space 54 irrespective of the stepped shape of the oil passage, since the stepped capillary plug 56 has the slot 57. The steel ball 48 is floatingly supported on the plunger 44. In order to attain a least possible frictional loss with the least possible leakage loss the steel ball 48 has preferably a diameter D equal to more than 1.2 times a diameter d of the small diameter portion of the plunger 44. The diameter D of the steel ball is more preferably 1.2 to 1.3 times the diameter d of the small diameter portion of the plunger.

In the cylinder block 14 are provided radial bores 60 communicating with the arcuate groove 36 or 39 of the sleeve 32 and the chambers 50 of the plungers 44 and 45, and inclined bores 61 opened into the closed chamber of the housing 16 and capable of communicating with arcuate groove 36. 62 is a sealing band for closing the bore 60 with respect to the closed chamber of the housing 16.

A pair of cams 64, 65 are disposed with the cylinder block 14 therebetween so as to contact with the steel ball 48 of the plunger assembly 42. The cam 64 at the end cover 20 side is fixedly mounted on the housing body 18, whereas the cam 65 is mounted on the radial wall of the housing body 18 through thrust roller bearings 66. A radial slot 68 is provided in the cam 65.

A piston-cylinder assembly 70 is provided so as to change a position of the cam 65 relative to the fixed cam 64. The piston-cylinder assembly 70 has a rod 72 with a piston 74 which is slidably moved within a cylinder 76 formed in the cylinder body 18. A discharge fluid, for example, from the port 22 is discharged from ports 81 and 82 through a change-over value or control valve 80 into cylinder chambers 77 and 78. To a piston is fixed a projecting rod 83 which is fixed into a radial slot 68 of the cam 65. By the slidable movement of the rod 72 the cam 65 is swung so that the position of the cam 65 relative to the fixed cam 64 can be varied. 85 is a guide pin which is inserted in an elongated hole 87 of the rod 72 so as to prevent a rotation of the rod 72.

The operation of the hydraulic equipment when it is used as a pump will now be explained below.

When the rotary shaft 12 is rotated, the cylinder block 14 is integrally rotated to cause the steel ball 48 of the plunger assembly 42 to be rotated in contact with the corresponding cam 64 or 65. In consequence, each plunger 44 is slidably moved within the cylinder bore 40 to cause a volume of the chamber to be varied. When the volume velocity is a minus value, a back pressure is created to cause, for example, a pressure oil or pressure gas to flow into chamber 50 through the port 25, inclined bore 61, arcuate groove 36 and radial bore 60. When, however, the volume velocity is a plus value, an discharge pressure is created, causing the pressure oil within the chamber 50 to be sent through the radial bore 60, arcuate groove 39, fluid axial bore 38, annular groove 37 and port 22. FIG. 2 shows a suction stroke and discharge stroke of the hydraulic equipment. The volume velocity within the chamber is determined by a relation between the cross-sectional area $A(=\pi d^2/4)$ of the diameter of the slidable portion of the plungers 44 and 45 and the velocities $V_1$ and $V_2$ of the plungers 44 and 45. The relation will be expressed as follows:

$$A\times(\pm V_1\pm V_2)$$

When the plungers 44 and 45 are moved toward each other, the volume velocities $V_1$ and $V_2$ of the plungers 44 and 45 have a plus value. When, on the other hand, the plungers 44 and 45 are moved away from each other, the volume velocities $V_1$ and $V_2$ have a minus value (see FIG. 5).

Figure 5:
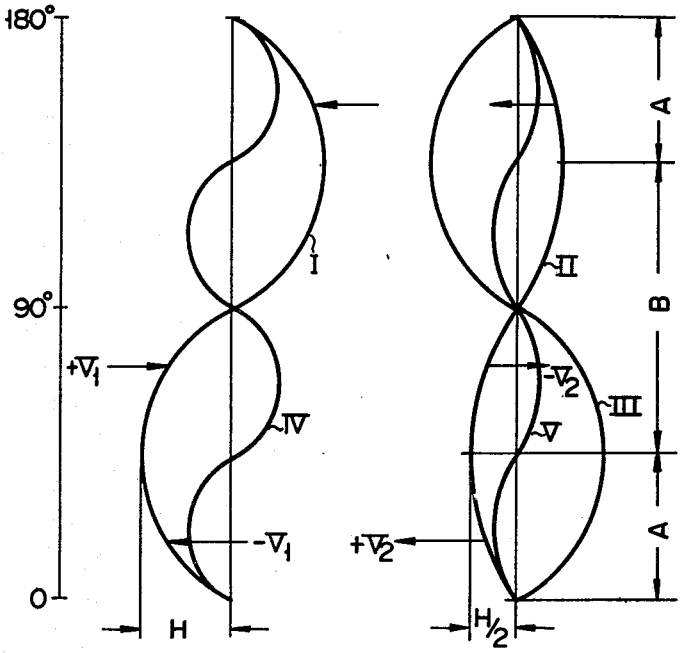
FIG. 5 is sine curves showing a relation between the cam surface of a cam and a change in the volume of a plunger chamber.

The cams 64 and 65 imparts a plurality of reciprocating movements to the plungers 44 and 45 during the one relative rotation thereof. The cams 64 and 65 have cam surfaces 84 and 86 for always imparting different moving velocities to the opposite plungers 44 and 45 in all phase position. FIG. 5 shows cam curves of the cam surfaces 84 and 86 of the cams 64 and 65. In FIG. 5, for example, the cam curve I of the cam surface 84 shows a sine curve with two crests of a stroke of H and the cam curve II of the cam surface 86 shows a sine curve with two crests and a stroke of H/2. In an area of A in FIG. 5 the moving velocity of the plunger 44 is $-V_1$ and the moving velocity of the plunger 45 is $+V_2$. Since $|V_1|>|V_2|$, $$-V_1+V_2<0$$

Since the volume velocity of the chamber 50 is a minus value, a suction function is obtained. In an area of B in FIG. 5 the moving velocity of the plunger 44 is $+V_1$ and the moving velocity of the plunger 45 is $-V_2$. Since $+V_1-V_2>0$, the volume velocity of the chamber 50 is a plus value and an discharge function is obtained. In this way, when different cam curves are utilized, there occurs no case where $\pm V_1\pm V_2$ become zero. In consequence, a smooth movement is obtained without involving any pulsating movement. Even when the same cam curves I and III are utilized, if a swinging movement of the cam 65 relative to the fixed cam 64 is less than $\pm 90°$ away from the position shown in FIG. 5, no pulsating movement is effected. Although in the above-mentioned embodiment the cam curve is shown as a sign curve, any other curve can be utilized. In one relative rotation of the cam the cam curve has two crests, but it may have a plurality of crests, for example, 4 crests. The fixed cam 64 may be made to have a sine curve IV with 4 crests and a stroke of H/2 and the movable cam 65 may be made to have a sine curve V with 4 crests and a stroke of H/4. Each group of the arcuate grooves 36 and 39 are made equal in number to the crests of the cam curves.

The respective arcuate grooves 36 and 39 are alternately provided around the sleeve.

The suction and discharge functions are performed by a relation of each plunger assembly relative to the cams 64 and 65. The variable delivery pump 10 is subjected to a variation of an algebraic sum (it is always a plus value) of the volume velocities of some plunger chambers 50 communicating with the respective bores 60 which lead to the arcuate grooves 39. As a result, the pump 10 can variably discharge the operational oil.

The swinging movement of the swingable cam 65 is effected by causing some of oil discharged from the port 22 to flow into either one of the cylinder chambers 77 and 78 through the control valve 80 and corresponding one of the ports 81 and 82. In the above-mentioned embodiment the movement of the piston 72 causes the projecting rod 83 to be slidably moved along the radial slot 68 of the cam 65 to permit the cam 65 to be swung through ±35°. In this range, the same cam curves can be used.

The operation of the hydraulic equipment 10 when it is used as a motor will now be explained below.

By causing a pressure oil to flow from the port 22 into the chamber 50 through the annular groove 37, axial bore 38, arcuate groove 37 and radial bore 60 and varying the volume velocity within the chamber 50 the cylinder block 14 and thus the rotary shaft 12 are rotated. The rotation torque of the shaft 12 can be varied by the pressure of the pressure oil and the swinging position of the cam 65. Since in any case the plungers 44 and 45 are axially moved due to the axial load, the radial and thrust loads are balanced and in consequence becomes zero. As a result, a smooth operation can be obtained.

As a different moving velocity is always applied to the plungers 44 and 45, no pulsating movement is effected. The swinging movement of the cam 65 can be remote-controllably automatically effected, with more accuracy than a manual operation, owing to the use of the hydraulically operated piston-cylinder assembly 70.

Since the operational oil is supplied to the oil space 54 and steel balls 48 or spherical cam followers are floatingly are supported through the oil film, the cam followers are smoothly rotated with a least friction. As a result, it is possible to provide a smoothly operated hydraulic equipment having a lengthy life. As such a cam follower use is made of steel balls. The steel ball accurately follows the cam surface of the cam to cause the plunger to be reciprocably moved. The cylinder block 14 is rotated together with the rotary shaft 12 and cams 64 and 65 are not rotated with respect to the rotary shaft. Since one cam 64 is fixed to the housing and the other cam 65 is swingable with respect to the fixed cam 64, the swingable cam 65 is easily swingable even during the operation. As a result, a desired discharge amount and desired rotation torque can be obtained.

In the above-mentioned hydraulic equipment the cylinder block is rotated together with the rotary shaft and the cams are not rotated with respect to the rotary shaft.

I now explain below another embodiment in which the cams are rotated integrally with the rotary shaft and the cylinder block is not rotated with respect to the rotary shaft.

Figure 6:
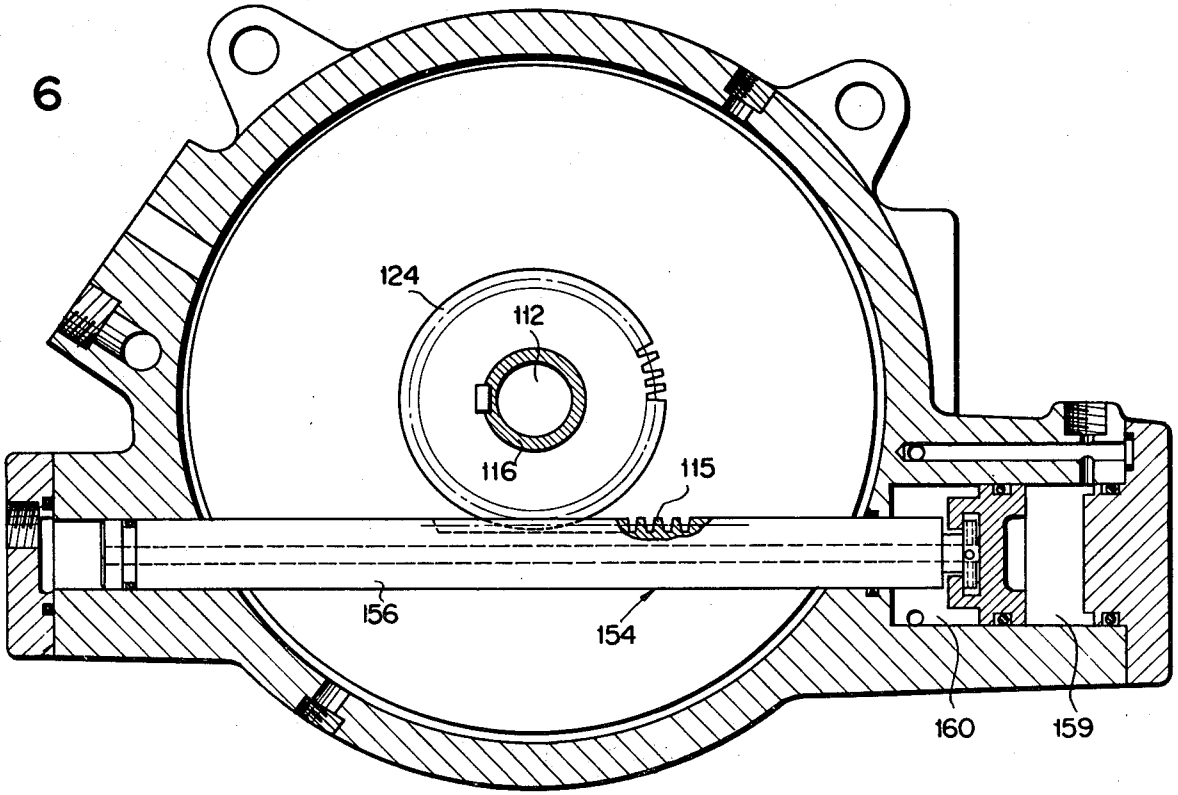
FIG. 6 is a cross-sectional view in side elevation showing a hydraulic equipment according to another embodiment of this invention.
Figure 7:
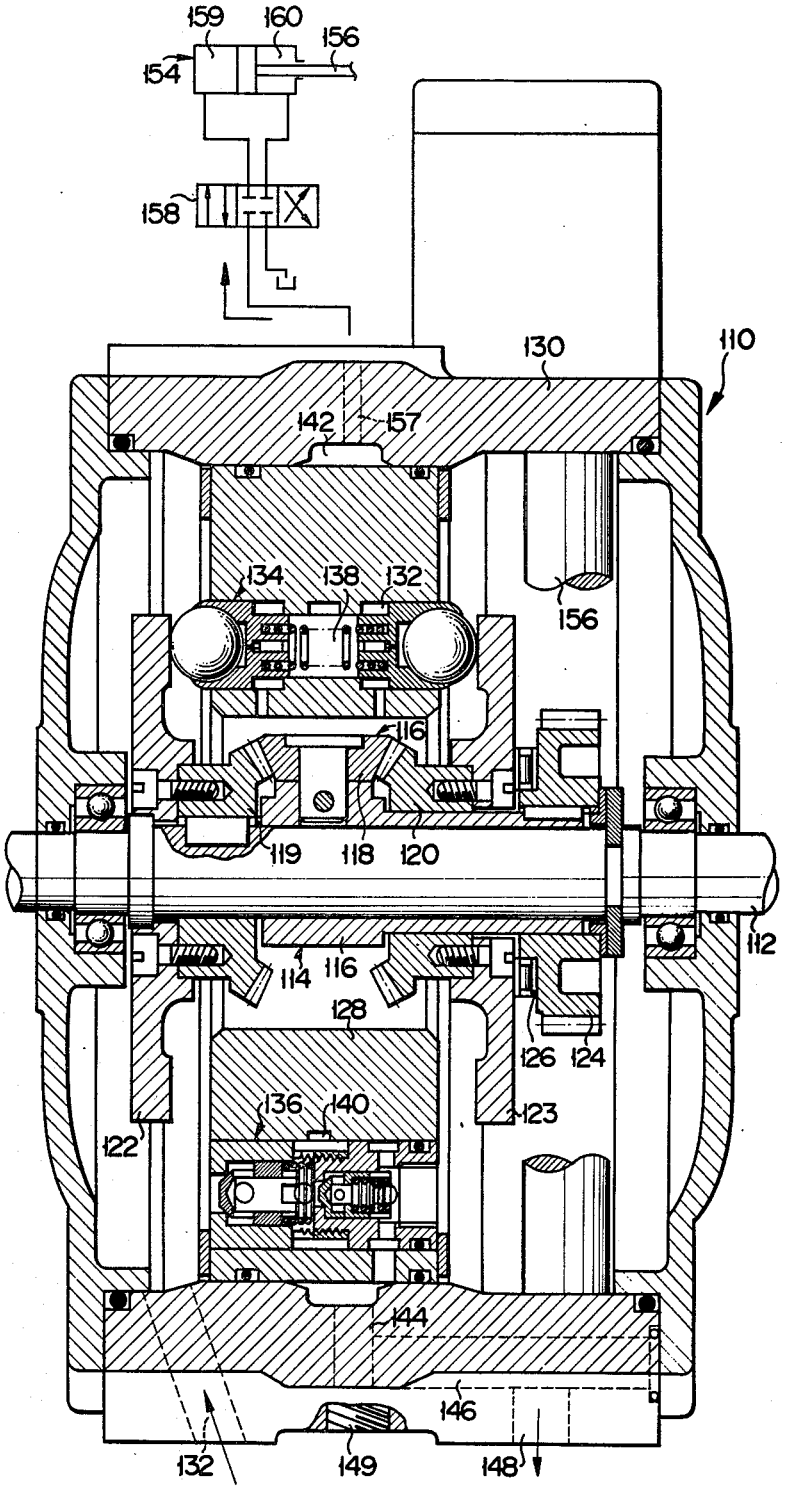
FIG. 7 is a longitudinal cross-sectional view showing the hydraulic equipment in FIG. 6.

As shown in FIGS. 6 and 7, a hydraulic equipment 110 has a rotary shaft 112 over which a stepped sleeve 116 of a differential gear mechanism 114 is loosely fitted. A shaft for an intermediate bevel gear 118 is fitted in the large diameter portion of the stepped sleeve 16. A pair of bevel gears 119 and 120 are engaged with the intermediate bevel gear 118. The bevel gear 119 is keyed to the rotary shaft 112 and a cam 122 is fixed to the bevel gear 119. The other bevel gear 120 is loosely fitted over a small diameter portion of the sleeve 116 and a cam 123 is fixedly mounted on the bevel gear 120. A pinion gear 124 is keyed to the small diameter portion of the sleeve 116 and a train of thrust roller bearings 126 is provided between the pinion gear 124 and the cam 123.

A cylinder block 128 is mounted on the housing 130 and has a plurality of cylinder bores 132 equiangularly provided on the same circumference thereof. Within the respective cylinder bore 132 a plunger assembly 134 is mounted. Between the plunger assemblies 134 each of valve assemblies 136 is mounted to the cylinder block 128. An operational oil flows through the bore 132 into a housing 130. When the hydraulic equipment 110 is used as a pump, if the rotary shaft 112 is rotated, the cam 122 is rotated through the bevel gear 119. Since the bevel gear 120 fixed to the cam 123 is engaged with the gear 119 through the intermediate gear 118, the cam 123 is rotated an equal amount in the reverse direction. The intermediate bevel gear 118 is rotated around the shaft thereof and it is not rotated around the rotary shaft 112. In consequence, the pinion gear 124 secured to the sleeve 116 is not rotated. Like the above-mentioned embodiment, a volume velocity of the chamber 138 for plungers is varied. When the plunger assembly 134 is in the suction stroke, an operational oil within the housing 130 is passed through the valve assembly 136 and flows into the chamber 138 through an annular groove 140 of the cylinder block 128. When the plunger assembly 134 is in the discharge stroke, the operational oil flows from the chamber 138 through the annular groove 140 and valve assembly 136 to an annular groove 142 and is discharged from a port 148 through bores 144 and 146. 149 denotes a sealing plug.

Figure 8:
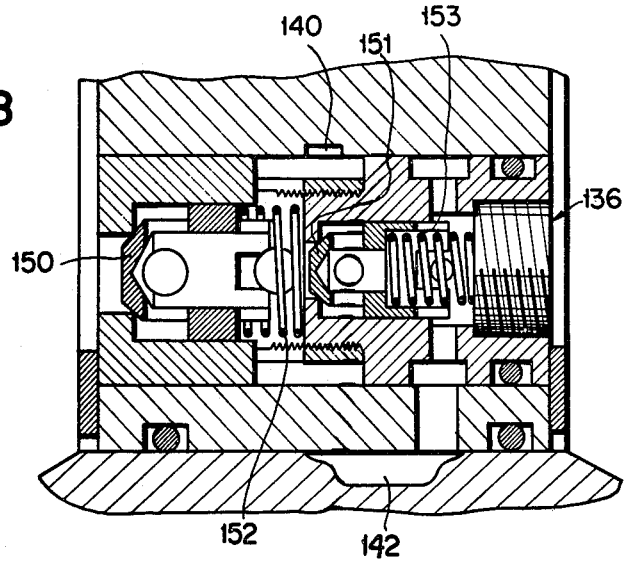
FIG. 8 is an enlarged view showing the detail of a value assembly in FIG. 7.

When the plunger assembly 134 is in the suction stroke, the valve assembly 136 permits a communication between the inlet port 132 and the annular groove 140. When the plunger assembly 134 is in the discharge stroke, the valve assembly 136 permits a communication between the annular groove 140 and the annular groove 142 and thus the outlet port 148. As shown in FIG. 8 the valve assembly 136 is of a dual valve type, and respective valve type, and respective valve bodies 150 and 151 are compressed by compression coil springs 152 and 153 toward a valve seat. When the volume velocity of the chamber 138 is a minus value, the valve body 150 is moved to the right against a biasing force of the spring 152 to cause the operational oil to flow through the valve assembly 136 into an annular groove 140. The spring 153 is formed to have such a biasing force as not to permit the valve body 151 to be opened at this time. When the volume velocity of the chamber 138 is a plus value, the operational oil discharged into the annular groove 140 from the chamber 138 causes the valve body 151 to be urged to the right against the biasing force of the spring 153, permitting the valve body 151 to be opened. In consequence, the operational oil is flowed into the annular groove 142 and discharged toward the outside through the bores 144 and 146 and outlet port 148.

In this embodiment, the piston-cylinder assembly 154 for the cam 123 includes a rod 156, as will be evident from FIG. 6, having a rack 155 in mesh with the pinion gear 124. If the rod 156 is moved by the operational oil flowing from a bore 157, communicating with the annular groove 142, into cylinder chambers 159 and 160 through a control valve 158, the pinion gear 124 is rotated in mesh with the rack 155. Since the pinion gear 124 is keyed to the sleeve 116, the intermediate bevel gear 118 provided integral with the sleeve 116 is rotated. The rotation of the gear 118 causes the gear 120 to be rotated, permitting the cam 123 secured to the gear 120 to be swung. As a result, the position of the cam 123 relative to the cam 122 is varied. In this way, the swinging movement of the cam 23 permits the hydraulic equipment 110 to be automatically remote-controlled in a stepless fashion. Since the above-mentioned embodiment has a rigid structure with the cylinder block fixed to the housing, a very high pressure or output can be obtained. According to experiments conducted it was found that a satisfactory operation can be obtained at an atmospheric pressure of 1000. Although the cams 122 and 123 are rotated together with the rotary shaft 112, the swingable cam 123 can be swung even during the rotation of the shaft 112 with respect to the fixed cam 122.

Figure 9:
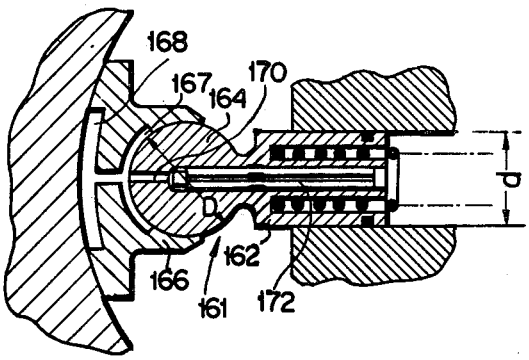
FIGS. 9 and 10 are longitudinal views each showing a modified form of a plunger assembly.

FIG. 9 shows a modified form of the plunger assembly. In FIG. 9, the plunger assembly 161 has at its outer end a spherical head 164 integral with the plunger 162. A cam follower 166 is so mounted on the sperical head 164 that it can be revolved around the spherical head 164. The cam follower 166 contacts with a cam and oil space 167 and 168 are formed one between the spherical head 164 and the cam follower 166 and one between the cam and the cam follower 166. An operational oil is supplied through an oil passage 170 into the oil space 167 and 168. If in this way use is made of the cam follower floatingly supported through the oil film from both the sides thereof, the plunger assembly with a least friction can be obtained without using any steel ball. In consequence, a very high speed (about 3000 rpm), variable delivery type pump or motor can be obtained. 172 shows a capillary plug similar to the capillary plug 56 in FIG. 4. The cam surface is formed utilizing the internal or external surfaces of a cylinder.

Figure 10:
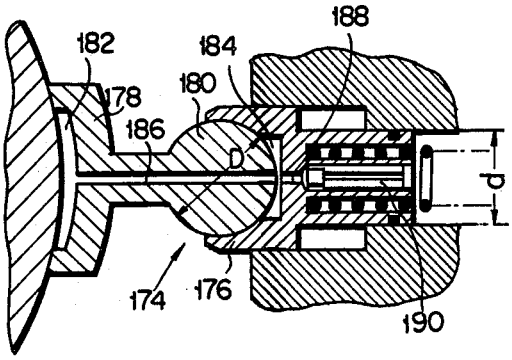

FIG. 10 shows another form of a plunger assembly. In a plunger assembly 174 in FIG. 10 a spherical head 180 of a cam follower 178 is revolvably mounted on the outer end of the plunger 176. The cam follower 178 contacts with an arcuate cam and an oil space 182 is formed between the cam surface and the cam follower 178. An oil space 184 is defined between the outer end of the plunger 176 and the spherical head 180 of the cam follower 178. The oil space 184 communicates with the oil space 186 through an oil passage 186 of the cam follower 178. Since the operational oil is supplied from the oil space 184 to the oil space 182 irrespective of capillarity, the oil passage 186 is not necessarily required to be of made smaller in size unlike an oil passage 188 of the plunger 176. In consequence, the oil passage 186 is not difficult to manufacture unlike the oil passage 188 of the plunger 176, even if it is somewhat lenghy. 190 denotes a capillary plug.

In a plunger assembly in FIG. 10, a cam follower 178 is floatingly supported through an oil film at each side thereof and the plunger assembly 174 can be smoothly operated with the least friction as in the case of the plunger assembly in FIG. 9.

In FIGS. 9 and 10, the diameter D of the spherical heads 164 and 180 is preferably more than 1.2 times, and more preferably 1.2 to 1.3 times, the diameter d of the small diameter portion of the plungers.

What is claimed is:

1. A variable delivery hydraulic equipment, comprising:

a rotary shaft rotatably supported on a housing;

a cylinder block disposed coaxially with and connected to the rotary shaft and having a plurality of axial cylinder bores provided on the periphery thereof and disposed coaxial with the rotary shaft;

a plurality of plunger assemblies each having a pair of plungers oppositely disposed within the respective cylinder bore, so as to define a chamber therebetween and slideably movable within the respective cylinder bore, and a pair of cam followers revolvingly mounted on the outer end of each plunger; and, a pair of cams between which the cylinder block is disposed, the cams being adapted to contact with the cam followers of the plunger assembly to impart a plurality of recipricatory movements in one cycle to the opposite plungers, each having a cam surface substantially perpendicular to the rotary shafts, and being so designed as to impart different and ever-changing moving speeds to the opposite plungers respectively, in all phase positions except when the moving speeds of both plungers are zero, one of which being swingable relative to the other cam by a piston-cylinder assembly adapted to be operated by an operational fluid within the equipment and being free with respect to the rotary shaft and the housing, and the other cam being fixed to the housing, said swingable cam having a radial groove at the side on which it does not face the cam follower and said piston-cylinder assembly having an operating element fixedly mounted on a piston rod and fitted into the radial groove of the swingable cam.

2. A variable delivery hydraulic equipment according to claim 1, in which each of the plunger assemblies has oil retainer means and the cam follower is floatingly supported using an operational fluid flowing into the oil retainer means through a communicating passage.

3. A variable delivery hydraulic equipment according to claim 2, in which the oil retainer means has a first oil space defined between the cam follower and the outer end of the plunger.

4. A variable delivery hydraulic equipment according to claim 3, in which the oil retainer means has a second oil space which is formed opposite to the cam surface of a cam.

5. A variable delivery hydraulic equipment according to claim 3, in which the diameter of that outer and support portion of the plunger on which the cam follower is supported is more than 1.2 times the diameter of the slidable section of the plunger.

6. A variable delivery hydraulic equipment according to claim 3, in which each of the plunger assemblies includes a capillary plug inserted into an oil passage of the plunger and adapted to always supply an operational oil to the first oil space of said oil retainer means under the action of capillarity.

7. A variable delivery hydraulic equipment according to claim 6, in which said capillary plug is a stepped solid cylindrical member inserted into the oil passage of the plunger in such a manner that a small diameter portion thereof is positioned on the first oil passage side, and said stepped solid cylindrical member has a large diameter section having an axial straight groove and a small diameter section having a slot across the diameter thereof.

* * * * *